United States Patent [19]

Walter et al.

[11] Patent Number: 4,836,380

[45] Date of Patent: Jun. 6, 1989

[54] PACKAGE, IN PARTICULAR, A RECEPTACLE, MADE OF DEEP-DRAWN MATERIAL

[75] Inventors: Kurt Walter; Jochen Weihe, both of Glauburg, Fed. Rep. of Germany

[73] Assignee: Hassia Verpackungsmaschinen GmbH, Ranstadt, Fed. Rep. of Germany

[21] Appl. No.: 192,479

[22] Filed: May 11, 1988

[30] Foreign Application Priority Data

May 30, 1987 [DE] Fed. Rep. of Germany ..... 3718255

[51] Int. Cl.[4] ..... B65D 1/34; B65D 6/04

[52] U.S. Cl. ..... 206/561; 206/568; 229/125.35

[58] Field of Search ..... 206/561, 568; 229/125.35

[56] References Cited

U.S. PATENT DOCUMENTS

| | | | |
|---|---|---|---|
| 3,083,821 | 4/1963 | Woodson | 206/568 |
| 3,682,366 | 8/1972 | Chung | 229/125.35 |
| 3,866,820 | 2/1975 | Zumsteg | 229/125.35 |
| 3,938,686 | 2/1976 | Milligan et al. | 229/125.35 |
| 3,997,677 | 12/1976 | Hirsch et al. | 229/125.35 |
| 4,762,246 | 8/1988 | Ashley et al. | 220/257 |

*Primary Examiner*—Allen M. Ostrager
*Attorney, Agent, or Firm*—Kurt Kelman

[57] ABSTRACT

The present invention is concerned with a receptacle made of deep-drawn plastic material, comprising at least two compartments suitable to accommodate dry feedstock, on the one hand, and pasty feedstock, on the other, and a sealing rim flange extending in the plane of the compartments' openings and also extending between the two compartments' openings sealed by a cover foil. To preclude a germinal impairment of the pasty feedstock to be loaded through the dust-developing dry feedstock, the receptacle according to the invention is configured such that between the cover foil (1) and the sealing rim flange (2), a thin intermediate foil (3) is provided and that the same is perforated over the dry feed-stock compartment (4).

7 Claims, 1 Drawing Sheet

PACKAGE, IN PARTICULAR, A RECEPTACLE, MADE OF DEEP-DRAWN MATERIAL

The present invention relates to a package of a plastic material, preferably made by deep-drawing by means of a pressure and/or vacuum and, in particular, relates to a receptacle comprising at least two compartments intended to accommodate dry feedstock, on the one hand, and pasty feedstock, on the other, and being provided with a sealing rim flange extending in the plane of the compartments' openings and also extending between the two compartments' openings sealed by a cover foil.

BACKGROUND OF THE INVENTION

Receptacles of the afore-described type also designated by dual-compartment receptacles, are known in the art, e.g. according DE-OS No. 26 53 906; 27 28 940; and according to DE-GM No. 83 29 744. Receptacles of this type are used to accommodate various types of feedstock within a package and to offer the same in one package for common consumption, with the different types of feedstock, such as yoghourt on the one hand, and dry Mueslis, on the other, being placed together only at the moment of use, i.e. after opening of the package for subsequent joint consumption. Despite all efforts to carry out the loading of such packages as sterile as possible by prior art measures, this cannot always be achieved satisfactorily with such packages because, on the one hand, the dry material of the feedstock referred to, never is available utterly sterile and, on the other hand, loading of the dry stock never can be carried out without the development of dust, it being irrelevant whether the pasty stock has been admitted prior to or after loading of the dry stock, i.e. dust and germ fallout in the area of the other chamber for the pasty stock as a rule particularly suitable for germinal multiplication, substantially, is unavoidable. Extended storage times for feedstock so loaded in a dual compartment cannot be taken into consideration.

OBJECTS OF THE INVENTION

It is an object of the invention to improve packages of the afore-mentioned type to the effect that a germ load of the moist/pasty feedstock be safely precluded when the second compartment is loaded with dry stock.

Moreover, it is an object of the invention to so configure the package that loading of the dry stock can be effected either through a hole provided in the intermediate foil or that the hole can be generated during loading in the intermediate foil.

Another object resides in taking steps such that the hole area cut remains in contact with the intermediate foil.

Finally, it is an object of the invention to so configure the package that the cover foil for actually sealing the package can be applied in simple fashion.

SUMMARY OF THE INVENTION

Accordingly, the invention provides a package, especially in the form of a dual-compartment receptacle, wherein between the actual cover foil and the seal rim flange of the package at least above the compartment for the pasty feedstock a thin intermediate foil is provided which when also located above the compartment for the dry feedstock is provided with a hole leading to the interior of the compartment for the dry feedstock. The loading operation on a package of this type, under consideration of usual sterilitiy conditions is carried out as follows, irrespective of whether the deep-drawn receptacles are passed through the loading station individually or continuously: First, the pasty feedstock is admitted to the compartment under sterile conditions after which the intermediate foil is applied and initially sealed, feasibly, over both compartments. Only then the dry feedstock through the thin intermediate foil is admitted to the compartment for the dry feedstock. For this purpose, the intermediate foil either is correspondingly pre-perforated or the intermediate foil non-perforated and sealed is simply pierced by the loading tube for the dry stock. In the event of a pre-perforated intermediate foil, the prepunched hole is precisely adapted to the cross-section of the loading tube such that the loading tube is closely embraced during reaching through of the intermediate foil. However, such a close embracement is not imperative as the other compartment containing the pasty feedstock is already sealed in complete and sterile manner thereby precluding admittance of germs thereto.

As the intermediate foil is firmly sealed onto the sealing rim flange, an initial seal of the cover foil, advantageously, can be foregone; it can rather be merely glued by a suitable adhesive, i.e. costly and cyclically operating sealing tools for the cover foil on the packaging machine in that case can be done without. Although it is not imperative to simultaneously cover the dry-stock compartment during applying the intermediate foil, it will be feasible to do so in the interest of an easy manufacture of such a package as otherwise, during passage of receptacles of this type, a plurality of strips of intermediate foils would have to be provided which would increase the mechanical efforts of the packing machine concerned; in addition, there is no need to see to it that the sealing rim flange area separating the two compartments from one another is required to extend in the passage direction. Basically, the problem as posed can also be solved in that only the chamber for the pasty feedstock is covered, after loading, with the intermediate foil and the dry-stock compartment is simply left open, i.e. the perforation of the intermediate foil for admitting the dry stock is then simply represented by the portion of the intermediate foil omitted in that area. The principle of the invention is, of course not restricted to a two-compartment configuration of such receptacles; it can rather also be readily applied if more than two compartments are provided in the receptacle.

BRIEF DESCRIPTION OF THE DRAWINGS

The invention will be described in greater detail in the following with reference to the accompanying drawings showing some different embodiments of the package according to the invention, wherein FIG. 1 schematically shows a plan view of an open dual-compartment receptacle.

DESCRIPTION OF THE DRAWINGS

Figure 1:
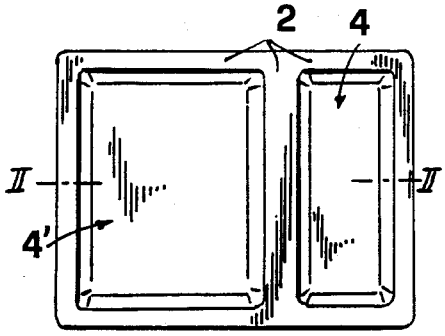
Figure 3:
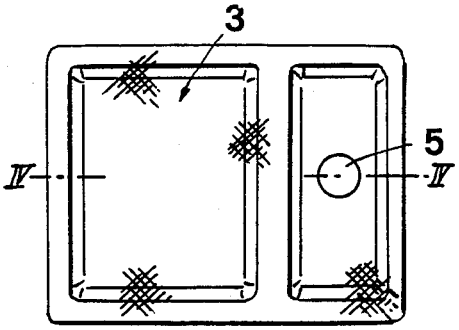
FIG. 3 schematically shows a plan view of the dual-compartment receptacle according to FIG. 1 with the intermediate foil applied and perforated.
Figure 2:
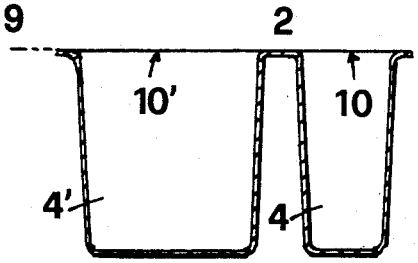
FIG. 2 schematically shows a section through the receptacle along the line II—II in FIG. 1.
Figure 4:
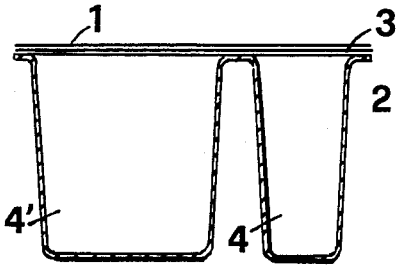
FIG. 4 is a section through the receptacle along the line IV—IV in FIG. 3, with the exception that the cover foil is applied.
Figure 6:
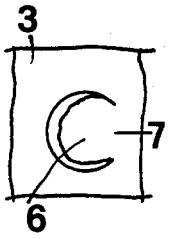
FIG. 6 is a partial plan view of the intermediate foil pierced after the loading operation of the dry-stock compartment.
Figure 5:
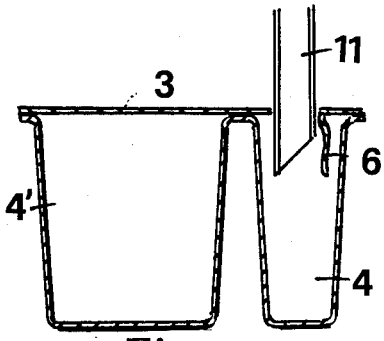
FIG. 5 shows a corresponding section through the receptacle with the intermediate foil, during loading of the dry feedstock.
Figure 8:
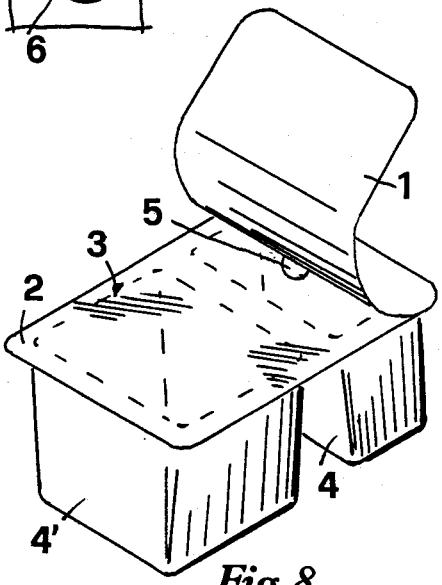
FIG. 8 is a perspective view of the dual-compartment receptacle with the cover foil withdrawn in part and the intermediate foil not yet withdrawn.
Figure 7:
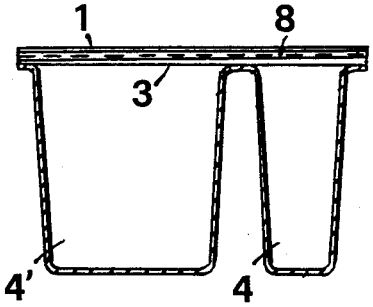
FIG. 7 is a sectional view of a special form of embodiment of the dual-compartment receptacle.

As revealed by FIGS. 1 to 7, the form of embodiment is a dual-compartment receptacle made of a deep-drawn plastic material for accommodating dry feedstock, on the one hand, and pasty feedstock, on the other. The compartment for the dry stock is designated by reference numeral 4 while the compartment for the pasty stock is designated by reference numeral 4'. Sealing rim flange 2 extends in the chamber opening plane 9 and is also provided between the two chamber openings 10,10' which are both sealed by the same cover foil 1. However, in the practice of the invention, a thin intermediate foil 3 of suitable, e.g. transparent film material is provided between cover foil 1 and sealing rim flange 2 and is perforated above the dry-stock compartment 4. As previously mentioned, the said hole 11 either may be provided, from the very start, in the applied intermediate foil 3 as a punch hole 5, or otherwise the said perforation is simply pierced as shown in FIG. 5, by means of a suitably formed loading tube 11 of a loading machine (not shown) for the loading operation, with the pierced hole area 6 of the intermediate foil 3 according to FIG. 6, advantageously, remaining in contact therewith by a remaining connecting stem 7 to prevent the hole area 6 from falling into the dry stock and enabling it to be readily removed during withdrawal of the intermediate foil 3 for opening the package. As only sterile covering, prior to loading the dry feedstock into compartment 4, of the other compartment 4', after loading of he pasty feedstock, will be of importance, it would also be adequate only to cover the compartment 4' with the intermediate foil 3 thereby insuring sterile sealing. However, for the reasons mentioned before, it is feasible and advantageous to cover both compartments 4,4' from the very start with the intermediate foil 3. In particular, when covering both compartments 4,4' with the intermediate foil 3, it can be considered to fix the cover foil 1 to the initially sealed intermediate foil 3 merely by an adhesive layer 8.

The invention is, of course, not restricted to the embodiments described in the afore-going, but can rather be varied within the scope of the following claims. For instance, the shape of the package, the number and form of the compartments and the arrangement thereof with respect to one another can be varied.

We claim:

1. A package, in particular, a receptacle, made of deep-drawn plastic material, comprising at least two compartments suitable to accommodate dry feedstock, on the one hand, and pasty feedstock, on the other, and a sealing rim flange extending in the plane of the compartment opening and also extending between the two openings of the compartments sealed by a cover foil, wherein a thin intermediate foil is provided between the cover foil and the sealing rim flange at least over the compartment for pasty feedstock, which cover foil when arranged also over the dry-stock compartment, is provided with a hole leading to the interior of the dry-stock compartment.

2. The package according to claim 1, wherein the intermediate foil over the dry-stock compartment is provided with a hole punched prior to application thereof.

3. The package according to claim 1, wherein the hole is punched in the intermedaite foil by the loading tube, and that the cut-out hole area of the intermediate foil remains in communication with the latter through a non-punched connecting bridge.

4. The package according to claim 1, wherein the cover foil is located on the intermediate foil by means of an adhesive layer.

5. The package according to claim 2, wherein the cover foil is provided on the intermediate foil by means of an adhesive layer.

6. The package according to claim 3, wherein the cover foil is provided on the intermediate foil by means of an adhesive layer.

7. The package according to claim 1, wherein the intermediate foil is of a transparent foil configuration.

* * * * *